United States Patent [19]

Rupe

[11] Patent Number: 4,977,965

[45] Date of Patent: Dec. 18, 1990

[54] AUTOMATIC DROP HAMMER SYSTEM

[76] Inventor: Robert E. Rupe, 225 S. Bent Ave., San Marcos, Calif. 92069

[21] Appl. No.: 389,516

[22] Filed: Aug. 4, 1989

[51] Int. Cl.[5] ..... B25D 9/00

[52] U.S. Cl. ..... 173/81; 173/87; 405/232

[58] Field of Search ..... 173/81, 82, 84, 85, 173/86, 87; 405/232

[56] References Cited

U.S. PATENT DOCUMENTS

| | | | |
|---|---|---|---|
| 3,216,511 | 11/1965 | Ladd et al. | 173/89 |
| 4,150,727 | 4/1979 | Shepherd | 173/81 X |
| 4,660,655 | 4/1987 | Wilner | 173/82 |

*Primary Examiner*—Frank T. Yost
*Assistant Examiner*—Willmon Fridie, Jr.
*Attorney, Agent, or Firm*—Henri J. A. Charmasson

[57] ABSTRACT

Disclosed is a device for automatically and continuously lifting and dropping a drop hammer. The device has hydraulic and mechanical components which lift and drop the hammer and electromechanical components which sequence various actions and ensure that the hammer is always dropped from a preset height above its last dropped position. This is useful for soil testing in accordance with America Society for Testing and Materials Test D 1586 "Standard Method for Penetration Test and Split Barrel Sampling of Soils" and other tests.

21 Claims, 4 Drawing Sheets

AUTOMATIC DROP HAMMER SYSTEM

FIELD OF THE INVENTION

This invention relates to hydraulic lifting equipment and electromechanical controls.

BACKGROUND OF THE INVENTION

The American Society for Testing and Materials publishes standard tests for many materials. One such test, Standard Method for Penetration Test and Split Barrel Sampling of Soils ASTM No. D-1586-84,describes the standard procedure for driving a split barrel sampler into the ground to obtain a representative soil sample and a measure of the resistance of the soil to penetration. This test is known in the industry as the "Standard Penetration Test" and is used extensively in a great variety of geo-technical exploration projects and ecology surveys. ASTM No. D-1586-84 p. 2. In this test, a 140 pound (63.5 kg) hammer is dropped on a split barrel sampler from a height of 30 inches (76 cm) above the barrel to force the barrel into the ground. The barrel, having been forced into the ground, picks out a plug of soil which is removed and analyzed in a laboratory.

While driving the barrel into the ground, the operator keeps track of the number of hammer blows needed to drive the barrel one foot (30 cm) into the ground. The number of blows per foot (30 cm) of penetration is called the N count or blowcount. Many widely published correlations relate this blowcount to the engineering behavior of soil and foundations. ASTM No. D-1586-84 p. 2.An accurate blowcount is essential to valid test results. The hammer must be dropped from 30 inches (76 cm) above the barrel before every blow to get an accurate blowcount. Although ASTM No. D-1586-84 allows the use of an automatic drop hammer system, a simple cathead is usually used. An operator simply winds the hammer line up on the cathead until it has lifted the hammer about 30 inches (76 cm). Carelessness and impatience introduce large error into the lift of the hammer. Therefore, blowcounts are likely to be very inaccurate. ASTM No. D-1586-84 does not describe any automatic drop hammer systems.

SUMMARY OF THE INVENTION

It is the principal object of this invention to provide a device which will automatically and repeatedly lift and drop a drop hammer from a height of 30 inches (76 cm) above its last drop point. It is also an object of this invention to provide a means for manual operation of a hydraulic winch, for raising and lowering the hammer before and after automatic operation.

These and other useful objects are achieved by attaching the drop hammer to a line which is run through a pair of pulley blocks and attached finally to a winch. One pulley block is fixed in position and the other is attached to a hydraulic cylinder actuating rod. The winch is used to take up any slack in the line, then is locked. The hydraulic cylinder then lifts the moving pulley block, thus lifting the hammer. When hydraulic power to the cylinder and winch is reversed, the actuating rod is quickly retracted and the hammer falls unimpeded. The cylinder and winch are powered by hydraulic oil and are controlled by solenoid valves. The solenoid valves are controlled by relays, pressure switches and limit switches. The lift of the hammer is controlled by a limit switch activated by the actuating rod. The accuracy of the lift is ensured because the winch takes up the slack in the line before the lifting stroke. An unimpeded hammer fall is ensured by driving the actuating rod down and forcefully turning the winch to provide plenty of slack in the line.

This device is useful for ASTM No. D 1586-84 and other materials and soils tests which would benefit from the advantages offered by the device.

DESCRIPTION OF THE PREFERRED EMBODIMENT

Figure 1:
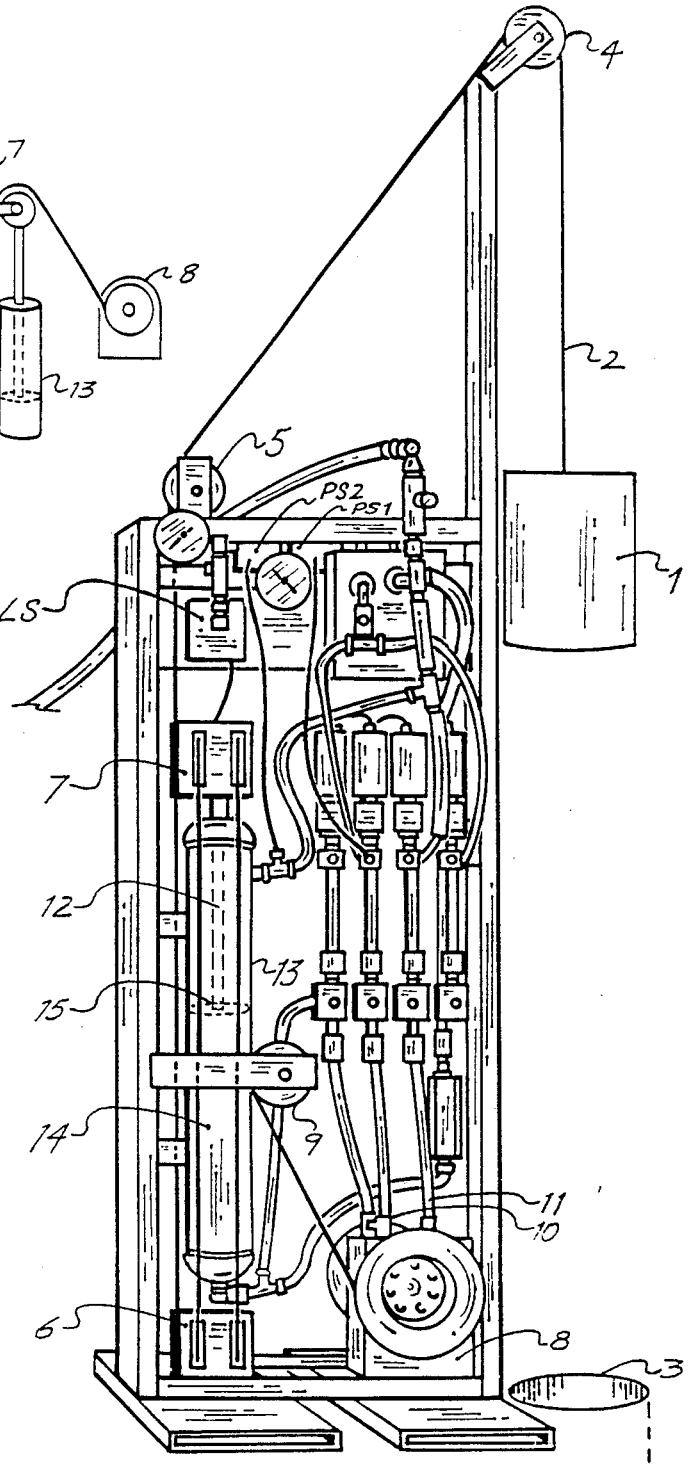
FIG. 1 is a perspective view of the apparatus.

Referring now to the drawings, FIG. 1 is a perspective view of the apparatus system. A drop hammer 1 is attached to a line 2 and lowered into a bore hole 3. The hammer line 2 runs up the bore hole, around pulleys 4 and 5, threads twice through a fixed double sheaved pulley block 6 and a moving double sheaved pulley block 7 and finally to a hydraulic winch 8 through a guide pulley 9. The winch 8 has a forward port 10 and a reverse port 11. The moving pulley block 7 is attached to the actuating rod 12 of a hydraulic cylinder 13. The winch 8 is actuated to wind up any loose line 2. Hydraulic oil to the winch 8 is cut off when the line 2 is tight as indicated when pressure switch PS1 senses high pressure in the forward port 10. The winch 8 is hydraulically isolated and thus hydraulically locked. Now hydraulic oil is supplied to the piston bottom chamber 14, thus raising the piston 15. This force acts through the actuating rod 12 to lift the moving pulley block 7. The winch 8 may be replaced, if desired, by a cylinder which is a hydraulic equivalent in this application.

A limit switch LS1 is installed so that it is activated when the actuating rod 12 has moved upward 7.5 inches (19 cm). This 7.5 inches (19 cm) travel of the actuating rod 12 lifts the hammer 1 30 inches (76 cm) because the double sheaved pulley block setup creates a 4 to 1 ratio of the block movement to hammer movement. The limit switch LS1 may be moved up or down to adjust the stroke of the hammer 1, and a different number of sheaves in each block may be used to alter the pulley ratio. Also, additional pulley block; pairs and lifting cylinders may be placed on the line to provide increased lifting power.

When the limit switch LS1 is hit by the actuating rod 12, hydraulic oil flow to cylinder 13 is reversed so that hydraulic oil is now supplied to the top chamber 16 to exert force on the piston 14. At the same time, the winch 8 is unlocked and hydraulic oil is supplied to the reverse port 9 of the winch 8 and the winch 8 unwinds to slacken out the line 2. The hydraulic cylinder 13 and winch 8 are operated fast enough that the fall of the hammer 1 is not impeded. Hydraulic oil forced from the piston bottom chamber 14 may be used to power the winch 8 in reverse. When the piston 15 has been forced all the way down, pressure builds up on the piston top chamber 16. This is sensed by pressure switch PS2. When pressure switch PS2 senses high pressure, it resets the system and reinitiates the entire sequence.

Figure 2:
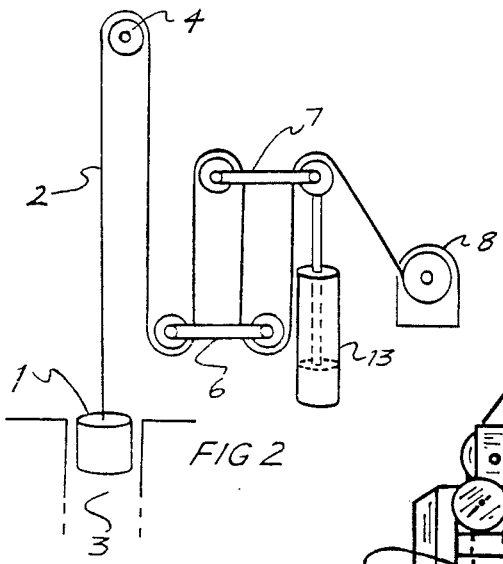
FIG. 2 is a diagram of the mechanical system.

FIG. 2 is a simplified diagram of the mechanical system. The drop hammer 1 is attached to the line 2. The line 2 is fed through a pulley 4, the fixed pulley block 6 and the moving pulley block 7 and finally to the winch 8. The moving pulley block 6 is attached to the actuating rod 12 of the cylinder 13. The winch 8 is used to tighten the line 2 until it is taught. When the line 2 is taught the cylinder 13 is used to lift the moving pulley block 7, thus lifting the hammer 1. When the hammer 1 is lifted the appropriate height the cylinder actuating rod 12 is retracted and the winch 8 is quickly rotated to provide extra slack in the line 2. This allows the hammer 1 to fall unimpeded. When the hammer falls, it drives the split barrel sampler 36 deeper into the bore hole 3, thus coming to rest below the initial position. This is the dropped position. The hammer 1 must be lifted 30 inches (76 cm) from this dropped position and dropped again. A thirty inch (76 cm) lift is ensured because the winch 8 takes up all slack in the line 2 before every lift.

Figure 3:
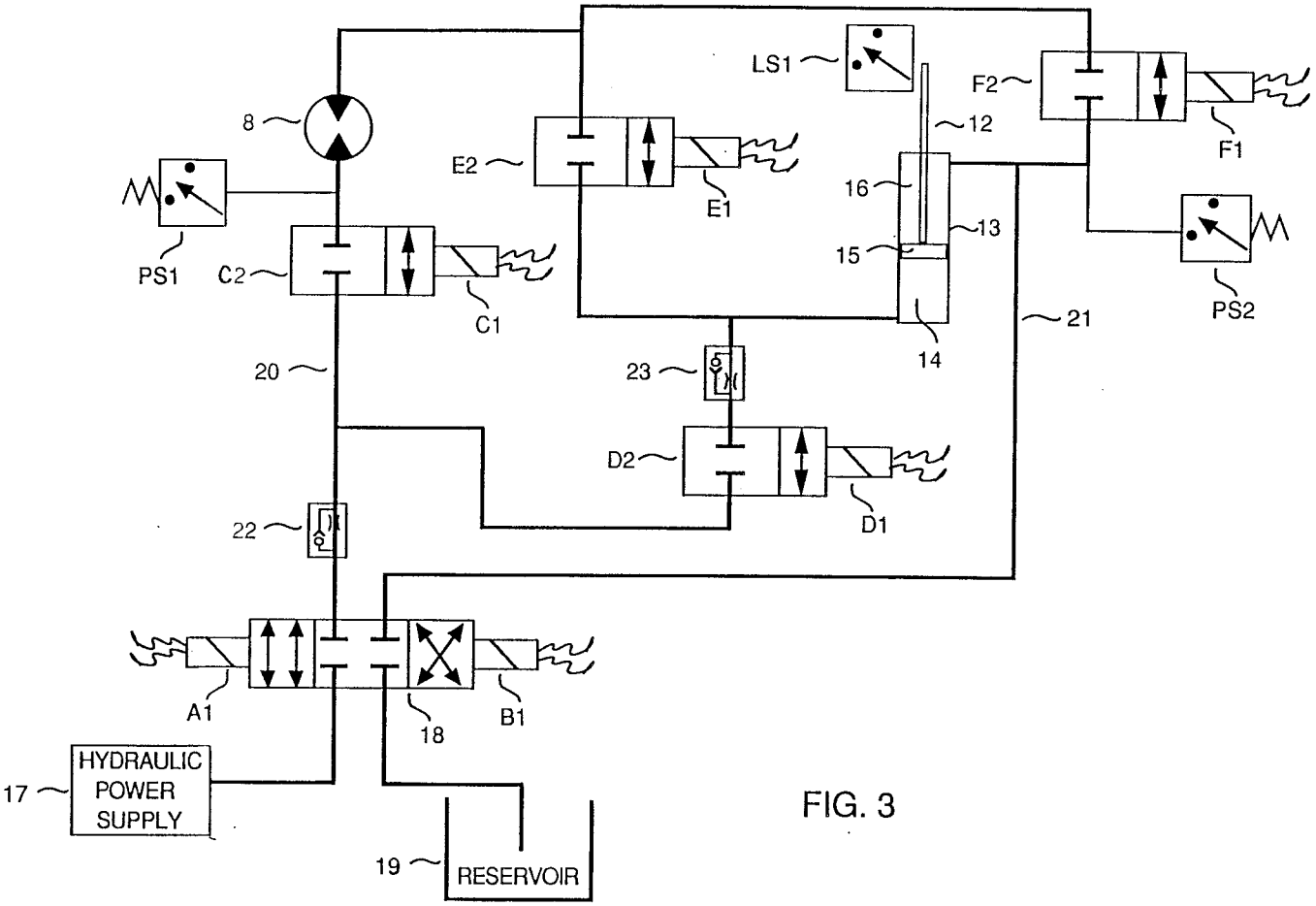
FIG. 3 is a schematic of the hydraulic system.

FIG. 3 is schematic of the hydraulic system. In understanding the hydraulic schematic, it is helpful to divide the machine operation into four distinct acts:

1. Taking up slack in the line.
2. Lifting the hammer.
3. Dropping the hammer.
4. Resetting the system for the next cycle.

The system is supplied by any available hydraulic power source 17 through solenoid operated four-way valve 18 which also acts to relieve operating hydraulic oil back to the reservoir of the power source.

Taking up slack: in the line solenoid A1 is energized and the four-way valve 18 is open straight. Solenoid C1 to open the winch forward supply valve C2. The winch return port 11, which is also the reverse supply port relieves through the forward winch return valve F2. Solenoid Fl is energized to open the forward winch return valve F2 which allows operating oil from the winch 8 to relieve the reservoir 19 through the four-way valve 18. When the line 2 gets tight, the pressure builds up in the forward winch supply line 20. This is sensed by pressure switch PS1 which then de-energizes solenoid C1 and solenoid F1, shutting valve C2 and valve F2 and hydraulically locking the winch 8.

Lifting the hammer: High pressure on pressure switch PS1 also causes solenoid Dl to energize, thereby opening the cylinder bottom supply/return valve D2. Four-way valve 18 is still open straight, so hydraulic oil is supplied, through valve D2 to the piston bottom chamber 14 thereby forcing the piston 14 and actuating rod 12 upward. The piston 14 and actuating rod 12 move upward until the limit switch LS1 is met.

Dropping the hammer: Contact between the limit switch LS1 and the actuating rod 12 causes solenoid A1 to de-energize and solenoid D1 to de-energize. It also causes solenoids B1, D1, E1, and C1 to energize. In this state, the four-way valve 18 is open/crossed to supply hydraulic oil to the top chamber 16 of the piston 14. Cylinder bottom supply/return valve D2 is open to relieve oil from the piston bottom chamber 14. Reverse winch supply valve E 31 is open to divert some piston bottom oil to the winch reverse port 23. Forward winch supply valve C2 is open and acts as the return valve for reverse winch operation. The piston 14 and actuating rod 12 are forced downward and the winch 8 is unwound. This relieves all tension on the line 2 and the hammer 1 falls.

Resetting the system: Pressure switch PS2 on the piston drive down supply line 21 senses pressure in the top chamber 16 of the cylinder 13 when the piston 14 has been driven all the way down. This condition indicates that the hammer 1 has fallen. Pressure switch PS2 operates to de-energize solenoids B1, D1, E1 and C1 and to energize solenoids A1, C1, and F1. This is the initial state of the system, and the cycle now repeats.

Included in the system are two bidirectional flow control valves. The winch flow control valve 22 throttles hydraulic oil flow for forward winch operation, which must be slowed to avoid lifting the hammer during any delayed response time of the pressure switch PS1, but allows unrestricted return flow from the winch forward port 10 during reverse winch operation. Cylinder flow control valve 23 throttles hydraulic oil flow to the cylinder bottom chamber 14 during the dropping action in order to force some return oil through the winch 8 during the dropping action, but allows unrestricted flow of hydraulic oil to the cylinder bottom chamber 14 during the lifting stroke.

Figure 4:
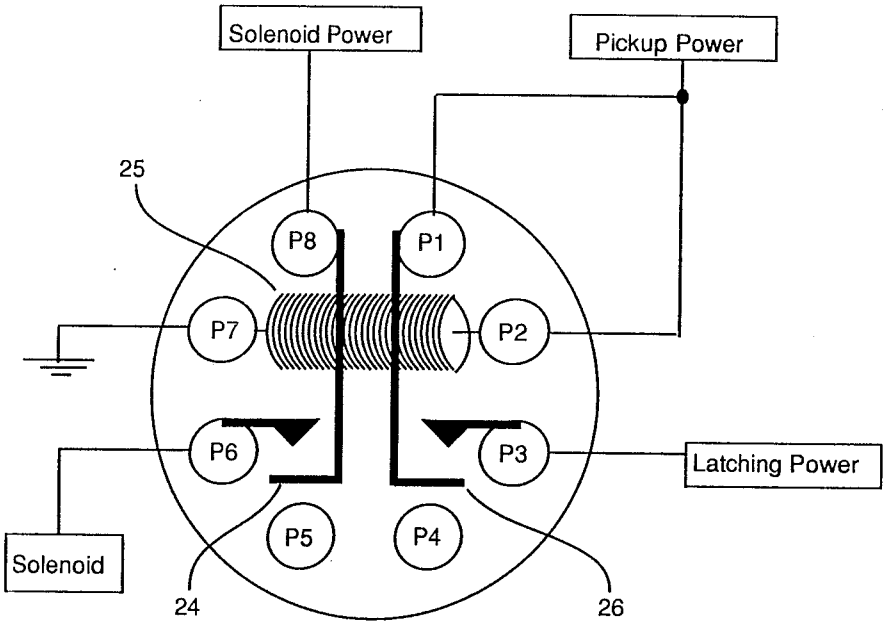
FIG. 4 is a schematic of the electric relay used.

FIG. 4 shows the electrical schematic for the control relays. All relays are wired the same, as follows:

Pole P8 is always energized from the power source and is connected to the solenoid power contact.

Pole P6 is connected to the corresponding solenoid valve. Power is supplied to pole P6, and hence to the corresponding solenoid valve, when the solenoid power contact 35 is lifted and latched. A latching coil 36 is connected between pole P2, and pole P7. Pole P7 is grounded. Pole P2 is to energize the latching coil 36 and energized to lift both the solenoid power contact 35 and the coil latching contact 26.

Pole P1 is connected to the coil latching contact 26, and is energized whenever Pole P2 is energized.

Pole P3 is energized through one of the control switches.

Figure 5:
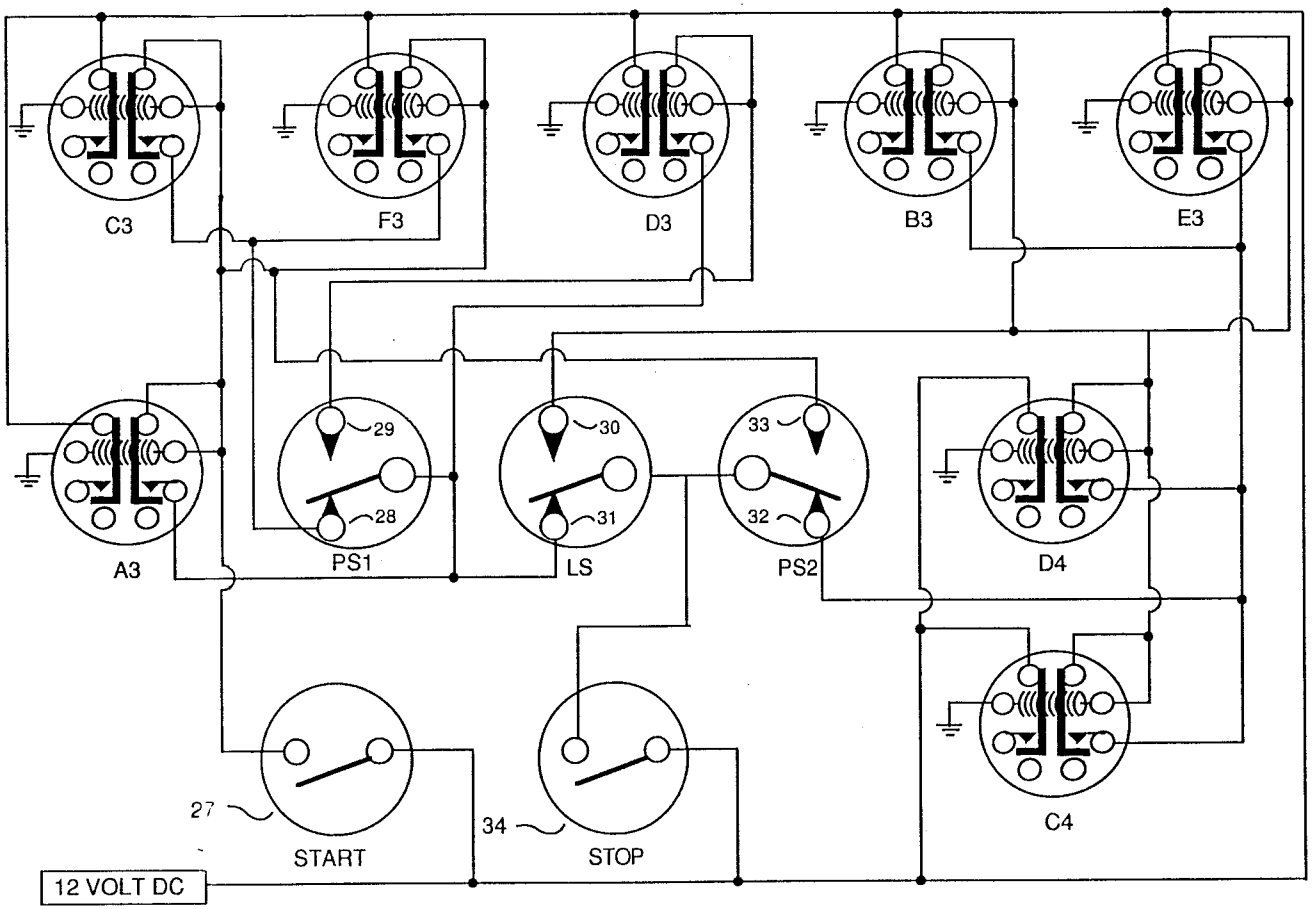
FIG. 5 is a schematic of the electric relay control system.

Poles P4 and P5 are not used. Each relay works in the same manner as follows:

When pole P3 is energized through the applicable control switch and voltage is momentarily applied to poles P1 and P2 the latching contact 26 is lifted into contact with pole P3. With voltage no longer applied to poles P1 and P2, voltage is supplied through pole P3 and the latching contact 26 to pole Pl, then to pole P2 and through the latching coil 36, through pole P7 to ground. Pole P3 thus acts as a latching power source. Power is supplied to the corresponding solenoid valve because the solenoid power contact 35 is always lifted in tandem with the latching contact 26, and completes the circuit between the power source, pole P8, pole P6 and the solenoid. Power to the solenoid is secured when the control switch opens and pole P3 is de-energized, thus de-energizing the latching coil 36, thus dropping both the latching contact 26 and the solenoid power contact 35. This breaks the circuit between pole P8 and pole P6, thus de-energizing the solenoid connected to pole P6. FIG. 5 shows the control circuit. Overall circuit operation is as follows:

Taking up slack: The spring loaded start switch 27 is depressed and momentarily energizes poles P1 and P2 on relays A3, C3, F3. This lifts the latching contact and power contact of each relay. Solenoids A3, C3, and F3 are thereby energized and valves A2, C2 and F2 of FIG. 2 are opened to start the winch tightening step. When the winch 8 is tight and forward winch supply line pressure increases, pressure switch PS1 breaks contact with the low pressure contact 28 and makes contact with the high pressure contact 29. Because the low pressure contact 28 of pressure switch PS1 is the only power source for latching pole P3 in relays C3 and F3, the latching contacts and power contact drop and the latching coil is de-energized and solenoid C1 and solenoid Fl are de-energized. Thus valve C2 and F2 are shut and the winch is hydraulically latched.

Lifting the hammer: The lifting sequence begins because the high pressure contact 29 of pressure switch PS1 energizes the pick up pole P2 of relay of D1. This picks up the latching contact, and contacts latching pole P3, thereby latching both the latching contact and power contact of relay D1. Thus solenoid D1 is energized and piston bottom supply/return valve D2 is open and hydraulic oil is supplied to the piston bottom chamber 14 and the piston 15 is raised. Thus, the piston 15 and actuating rod 12 move upward until reaching and contacting the limit switch LS1.

Dropping the hammer: When the actuating rod hits limit switch LS1, it switches to the drop contact 30. This de-energizes pole P3 of relay D1. Also, the latching pole P3 of relay A3 is de-energized and solenoid A1 is de-energized. Contact with the drop contact 30 of LS1 supplies voltage to the pick up poles pole P2 of relays B3, D3, F3 and C3, lifting the latching contact and power contact of each relay. Latching power is supplied to relay B3, D3 and E3 through pressure switch PS2. Relay C3 energizes solenoid C1 and opens valve C2. Pressure is relieved in the forward winch supply line 20 and PS1 resets, thereby providing latching power to relay C3. Valves C2, D2, and E2 are now open and the four way valve 18 is open/crossed and the drop action occurs as discussed in FIGS. 1 and 2. The drop action resets limit switch LS1, but this has no effect in relays B3, D4 or E3 because they are not latched and no effect on relay A3 or D3 because no pick up voltage is applied and no effect on relay F3 because no pick up voltage is applied. Because PS1 was reset when valve C2 opened, relays C3 and G3 are now supplied with latching voltage.

Resetting the system: Pressure switch PS2 senses pressure on the piston top chamber 16. When the piston has reached the bottom of the cylinder, pressure builds in the piston top chamber 16, pressure switch PS2 switches from the low pressure contact 32 to the high pressure contact P8. This breaks contact with the low pressure contact 32, and removes latching voltage from relays B3, D4 and E3 and de-energizes solenoids B1, D1 and F1. Contact with the high pressure contact P8 supplies pick up voltage to relays A3, C3, and F3 thus reinitiating the sequence.

The sequence repeats until the stop switch 34 is opened, thereby de-energizing all latching poles P3 and pick up poles P2.

What is claimed is:

1. A hammering device which comprises:
- a drop-weight;
- a line attached to the weight;
- means for vertically pulling the line to lift the drop-weight;
- means for releasing the line to drop the drop-weight when the drop-weight has been lifted to a specified height above the last dropped position of the hammer;
- means for taking ups slack in the line after the drop-weight has been dropped;
- means for coupling said means for vertically pulling and said means for taking up slack;
- electromechanical means for controlling and sequentially operating said various means;
- wherein:
  - said means for coupling comprises at least one pulley block having at least one sheave;
  - said means for taking up slack in the line comprises:
    - a winch coupled to the line,
    - said line engaging said pulley block,
    - means for operating the winch to draw and hold said line taut, and
    - means for preventing the winch from lifting the drop-weight;
    - the means for vertically pulling the line comprises:
    - a hydraulic cylinder, said cylinder coupled to the line, means for fixing the end of the line,
    - and means for preventing the winch from lifting the drop-weight.

2. The device of claim 1 wherein the means for preventing the winch from lifting the drop-weight comprises:
- a pressure switch which senses the pressure of the hydraulic power supplied to the winch;
- means for shutting off hydraulic power supplied to the winch before the pressure sensed by the pressure switch is high enough to cause the winch to lift the drop-weight.

3. A hammering device which comprises:
- a drop-weight;
- a line attached to the weight;
- means for vertically pulling the line to lift the drop-weight;
- means for releasing the line to drop the drop-weight when the drop-weight has been lifted to a specified height above the last dropped position of the hammer;
- means for taking ups slack in the line after the drop-weight has been dropped;
- means for coupling said means for vertically pulling and said means for taking up slack;
- electromechanical means for controlling and sequentially operating said various means;
- wherein:
  - said means for coupling comprises at least one pulley block having at least one sheave;
  - said means for releasing the line to drop the drop-weight when the drop-weight has been lifted the specified height comprises:
    - means for determining the height of the drop-weights;
    - means for releasing the means for vertically pulling in response to said means for determining the height;
    - said means for vertically pulling comprises a hydraulic cylinder coupled to the line.

4. The device of claim 3 wherein the means for determining the height of the drop-weight comprises:
- a limit switch responsive to the movement of the pulley block.

5. The device of claim 4 wherein the means for releasing the means for vertically pulling comprises:
- the hydraulic cylinder coupled to the line.

6. The device of claim 3 which further comprises:
- a means for determining when the drop-weight has been dropped;
- means for automatically lifting the drop-weight after each drop.

7. The device of claim 3 wherein the means for determining when the drop-weight has been dropped comprises:

a pressure switch which senses pressure of the hydraulic power source applied to the cylinder.

8. The device of claim 3 which further comprises:

the means for locking the winch.

9. The device of claim 8 wherein the means for locking the winch comprises:

means for hydraulically isolating the winch whereby the winch is hydraulically locked.

10. The device of claim 3 which further comprises:

means for unwinding the winch by a length of line sufficient to allow the drop-weight to fall freely.

11. The device of claim 3, wherein the means for vertically pulling further comprises:

at least one pair of pulley blocks, said pulley blocks having at least one sheave each, one pulley block of said pair being fixed in position and other pulley block being movable;

means for fixing the location of said fixed block; and means for attaching said moving block to the hydraulic cylinder.

12. The device of claim 11 which further comprises:

at least one additional means for vertically pulling coupled to the line.

13. A device for continuously operating a drop hammer which comprises:

a line attached to the hammer;

a hydraulic power source;

a hydraulic cylinder with a piston bottom chamber and top chamber;

an actuating rod which is operated by the hydraulic cylinder;

a pair of pulley blocks having at least one sheave each through which the line is run;

means for attaching one said block to the actuating rod;

means for fixing the position of one said block;

means for translating any force acting on the line to a vertical force acting on the hammer;

a winch with a forward port and reverse port;

means for connecting the line to the winch;

means for applying hydraulic pressure to the winch forward port;

said line run through the pair of pulley blocks; and attached to the winch, said line being drawn taught by the winch and said line exerting lifting force on the hammer when force is exerted on the moving pulley block, whereby the movement of the moving pulley block is translated into vertical movement of the hammer;

a first pressure switch for sensing pressure of hydraulic oil supplied to the winch forward port;

means for securing hydraulic pressure to the winch forward port when said first pressure switch senses high pressure in the winch forward port, thereby preventing the winch from lifting the hammer;

means for hydraulically locking the winch so that the line is fixed and all movement of the moving pulley block is translated to the hammer;

a limit switch which senses the extension of the cylinder;

means for retracting the cylinder whenever the limit switch senses that the hammer has been lifted to the desired height;

means for unwinding the winch whenever the limit switch senses that the hammer has been lifted to the desired height;

a second pressure switch which senses pressure of hydraulic power supplied to the cylinder during the retraction of the cylinder;

means for resetting the system when said second pressure switch senses high pressure which indicates that the cylinder is fully retracted;

electromechanical means for controlling and sequencing said means.

14. The device of claim 13 which further comprises:

means for manually controlled operation of the winch whereby the hammer is lifted and lowered.

15. The device of claim 1 which further comprises:

means for manually controlling the lifting of the drop-weight.

16. The device of claim 13 which further comprises:

a split barrel sampler positioned under the hammer.

17. A hammering device which comprises:

a drop-weight;

a line having one end attached to said drop-weight;

means for supporting a first section of the line in a general vertical orientation for a distance above said drop-weight;

a line take-up means connected to the other end of the line;

means for causing said line take-up means to tautly draw a second section of the line between said means for supporting and said line take-up means;

means for deflecting said tautly drawable second section to lift the weight to a predetermined height; and means for releasing said means for deflecting and said line take-up means to allow the drop-weight to drop freely; wherein:

said means for deflecting comprise a pulley engaging said second section; and means for translating said pulley to deflect said second section.

18. The hammering device of claim 17, wherein said means for translating comprises an hydraulic actuator shaped and positioned to act on said pulley block.

19. The hammering device of claim 18, wherein said hydraulic actuator is an hydraulic cylinder.

20. The hammering device of claim 18, wherein said line take-up means comprises a hydraulic actuator shaped and positioned to axially pull said other end of the line.

21. The hammering device of claim 20, wherein said hydraulic actuator is a winch.

* * * * *